US005090277A

United States Patent [19]

Spiller

[11] Patent Number: 5,090,277

[45] Date of Patent: Feb. 25, 1992

[54] SKI BOOT KEY

[76] Inventor: Mildred E. Spiller, 6773 Caminito del Greco, San Diego, Calif. 92120

[21] Appl. No.: 596,559

[22] Filed: Oct. 11, 1990

Related U.S. Application Data

[63] Continuation of Ser. No. 341,842, Apr. 24, 1989, abandoned.

[51] Int. Cl.[5] ..... B25B 33/00

[52] U.S. Cl. ..... 81/488; 29/278; 81/3.55; 254/131

[58] Field of Search ..... 81/125.1, 488, 3.07, 81/3.09, 3.4, 3.55; 29/270, 278; 7/151; 254/131

[56] References Cited

U.S. PATENT DOCUMENTS

| | | | |
|---|---|---|---|
| 64,662 | 5/1867 | Gold | 81/125.1 X |
| 172,277 | 1/1876 | Norris | 81/488 X |
| D. 176,005 | 11/1955 | Cariello | 81/125.1 X |
| 896,458 | 8/1908 | Morgan | 81/125.1 X |
| 1,464,128 | 8/1923 | Coes | 81/125.1 X |
| 1,899,203 | 2/1933 | LaBreche | 7/151 |
| 2,507,570 | 5/1950 | Jensen | 7/151 X |
| 4,304,019 | 12/1981 | Sava | 81/488 X |
| 4,463,631 | 8/1984 | Barnes et al. | 7/151 X |

OTHER PUBLICATIONS

Front and Rear Faces of a Backing Sheet for Packaging a Tool Produced Some Years Ago (Exact Date Unknown) by Ski People and Called in U.S. Ski Team Super Tool.

*Primary Examiner*—Joseph M. Gorski

*Attorney, Agent, or Firm*—Brown, Martin, Haller & McClain

[57] ABSTRACT

A ski boot key for operating ski boot pivotal closure latches comprises a rigid elongate member having a first opening at one end for fitting over the end of a ski boot side closure latch and a second, larger opening at the opposite end for fitting over the end of a ski boot rear toggle latch. The appropriate end of the key is placed over a skit boot latch and leverage is applied by grasping the opposite end of the key and urging it in a direction to force the latch towards its closed position. The key can also be used in an opposite direction to release the latches.

9 Claims, 2 Drawing Sheets

SKI BOOT KEY

This is a continuation of application Ser. No. 07/341,842, filed Apr. 24, 1989 and now abandoned.

BACKGROUND OF THE INVENTION

The present invention relates generally to a ski boot key or closure device for operating ski boot latches or clasps.

Ski boots for downhill skiing are generally formed of relatively rigid plastics material, and enclose the wearer's foot and ankle region for support when skiing. The boots have openings for allowing the foot to be inserted or removed, with pivotal closure latches or clasps for drawing the sides of the opening together and fastening them in a closed position. One type of ski boot has a single opening extending along one side of the boot from a position close to the toe region up to the top edge of the boot, with a series of spaced pivotal clasps or buckles extending along one side of the opening which are connected to loops secured along the opposite overlapping side of the opening to draw the sides together into a closed, tightened position when pivoted into a flat position. Other types of ski boots have opposite side openings extending upwardly from the ankle region and drawn together by one or more similar pivotal fasteners or clasps connected to loops extending across the back of the boot. This type of boot generally also has a rear pivotal closure or toggle latch for tightening the boot around the ankle region.

Ski boot closure latches are typically relatively stiff and difficult to close, particularly in cold, snowy or icy conditions, or if adjusted to a very tight fit. Also, in use, ski boots tend to become caked with snow and ice, stiffening the closures or clasps and making them difficult to release and reclose. The skier will normally be wearing padded gloves which also adds to the difficulty of closing two or more rigid, pivotal clasps. These factors typically make handling of ski boot closures or clasps rather awkward, and particularly difficult for those having limited dexterity or strength as a result of cold or for other reasons, for example women, children or anyone with a limited grip. Thus, there is a tendency to have the clasp positioned at a looser or slacker setting than is advisable for good ankle support and control.

SUMMARY OF THE INVENTION

It is an object of this invention to provide a means for operating ski boot latches or clasps more easily.

According to the present invention, a ski boot key or operating device is provided which comprises a rigid, generally flat, elongate member having an opening at one end for fitting over the end of a pivotal ski boot side closure clasp or latch so that a person holding the opposite end of the member can apply leverage to the latch to draw it into a closed position more readily. Preferably, the member has a first opening at one end for fitting over a side closure latch and a second, larger opening at the opposite end for fitting over a rear closure latch or clasp. The openings will be just large enough to fit over the ends of the respective latches and apply the desired leverage.

The key may be of any suitable, sufficiently rigid material such as metal or relatively rigid plastics material, for example a plastics material of the type used in making ski boots or ski boot latches. Preferably, a tether is attached at one end to the key and includes a suitable clasp at the opposite end for attachment to a belt, loop or other region on the skier's clothing, so that the key is readily available for use and the risk of losing the key while skiing or dropping the key in the snow on use is reduced. The tether is preferably long enough to allow the key to remain attached to the clothing while the user is operating it to close or release the ski boot fastening latches or clasps, so that if it is dropped it will not be lost in the snow.

In a preferred embodiment of the invention the key comprises a generally flat planar web of plastics material having generally rectangular openings of different sizes according to the side and rear ski clasp or latch sizes. The central area of the web between the openings may be recessed with the outer rim surrounding the recess and the openings being thicker for strengthening. The rim surrounding the openings must be narrow enough to permit it to be passed relatively easily over the end of a ski boot latch in a closed, latched position. Keys of various colors may be provided for color coordinating.

The ski boot key of this invention thus provides a readily available boot operating device which can be easily carried around while skiing, for example in a pocket, and secured to a belt or the like via a tether for security. This device will enable the latches or clasps to be closed relatively easily simply by slipping the appropriate opening over the end of a latch and using leverage to urge it closed, and may be used in a similar manner to release or open the latches. Thus, the latch can be adjusted to the appropriate tight setting and still be closed relatively easily. This will reduce the tendency of those people encountering difficulty in closing boot latches or clasps to have their boots too loose, which could entail some risk of injury.

BRIEF DESCRIPTION OF THE DRAWINGS

The present invention will be better understood from the following detailed description of a preferred embodiment, taken in conjunction with the accompanying drawings, in which like reference numerals refer to like parts, and in which.

DESCRIPTION OF THE PREFERRED EMBODIMENT

Figure 1:
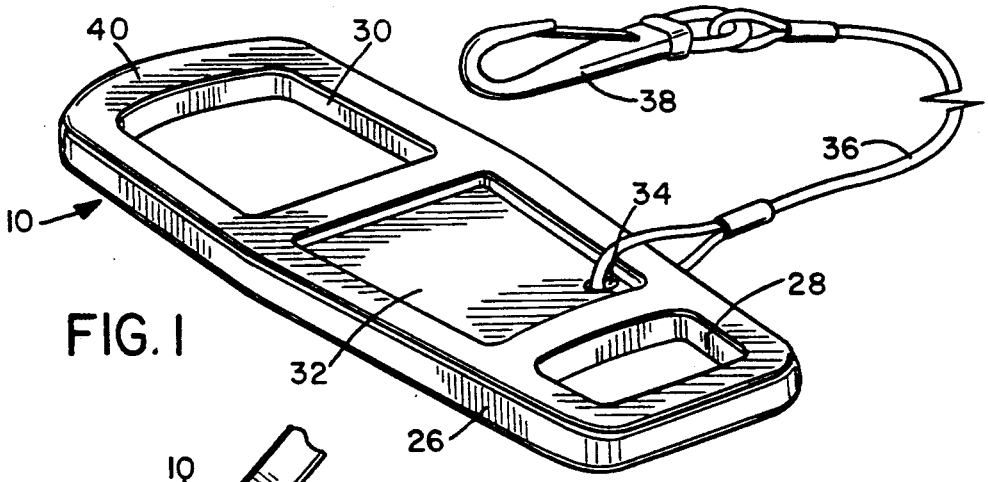
FIG. 1 is a perspective view of the latch operating key according to a preferred embodiment of this invention.
Figure 2:
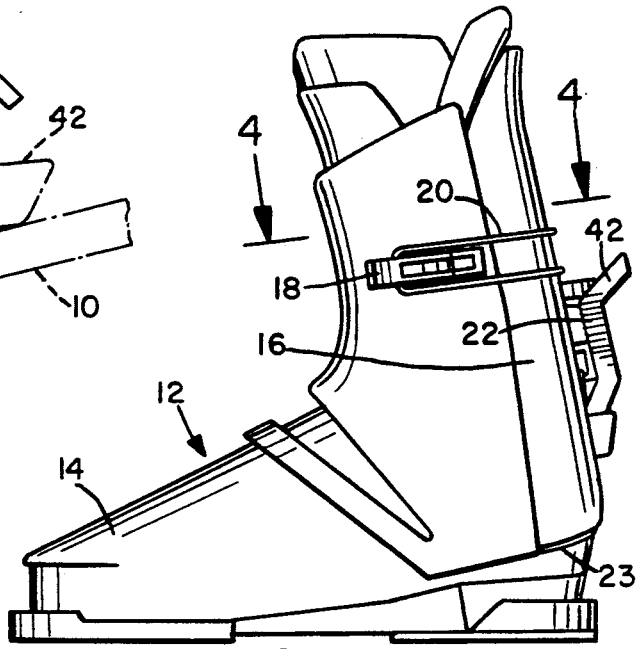
FIG. 2 is a side elevation view of a typical ski boot illustrating the latches.

FIG. 1 illustrates a ski boot key or latch operating device 10 for closing the clasps or fastenings of a ski boot. FIG. 2 illustrates a typical ski boot 12 with which the device 10 can be used. The ski boot 12 in FIG. 2 has a toe region 14 and an ankle or cuff region 16, and includes a pivotal side closure clasp or latch 18 which is secured to loop 20 which extends around the rear of the boot. When the latch or clasp 18 is pivoted into the flat position illustrated in FIG. 2, loop 20 is extended around the boot to draw it into a closed position around the wearer's ankle region. The boot 12 also has a pivotal rear toggle clasp or latch 22 which is secured to wire 23 which extends from the latch around the ankle region of the boot to fasten the boot more securely around the wearer's ankle when in the upright, closed condition illustrated. In the following description, the use of key 10 to operate the latches of a ski boot of the type illustrated in FIG. 2 is explained. However, it will be understood that the key 10 can be used to operate the closure latches or clasps of other types of ski boot, including those with only side latches which extend from the toe region to the upper edge or cuff of the boot.

The key or operating device 10 basically comprises an elongate, flat or planar member 26, preferably molded from a rigid plastics material such as the type of plastics material used in making ski boots or latches. The member 24 has a first, generally rectangular opening 28 at one end designed to fit over the end of a ski boot side opening latch, and a second, generally square or rectangular opening 30 at the opposite end which is of larger dimensions and which is sized to fit over the end of a ski boot rear opening latch. The dimensions of the openings 28,30 will depend on the dimensions of the closure latches or clasps on the boot with which they are to be used. Generally, side and rear closure latches do not vary much in dimensions between manufacturers, and keys having the same dimensions may be provided with appropriately dimensioned openings to fit most side and rear latches. Keys 10 in various different colors may be provided so that they can be color-coordinated with boots and/or other ski apparel.

The member 26 has a central, recessed area 32 between the opposite end openings, and a small circular tether hole 34 is provided in the recessed area 32 adjacent the smaller opening 28. A tether line 36 is secured at one end through tether hole 34, as illustrated in FIG. 1, and has a suitable clasp or catch 38 at its opposite end for securing it to a suitable loop, belt, buttonhole or the like on a skiers clothing.

The member 26 is preferably relatively lightweight, but sufficiently rigid to withstand the leverage forces applied to the member in closing the latches, as explained below. The thickened rim 40 surrounding recessed area 32 and openings 26 and 28 adds to the rigidity of the member. In one particular example, the rim was of ¼ inch thickness while the material in the recessed area 32 was ⅛ inch thick, with recesses of equal depth on opposite side faces of the member. The smaller opening 28 had dimensions of the order of 1 inch by ⅝ inch, while the larger opening 30 had dimensions of the order of 1.25 inches square. The larger opening was slightly larger across its lower end adjacent the central area 32 to enable it to be slipped over the rear latch more easily. Preferably, the corners of each of the openings are slightly rounded.

Figure 3:
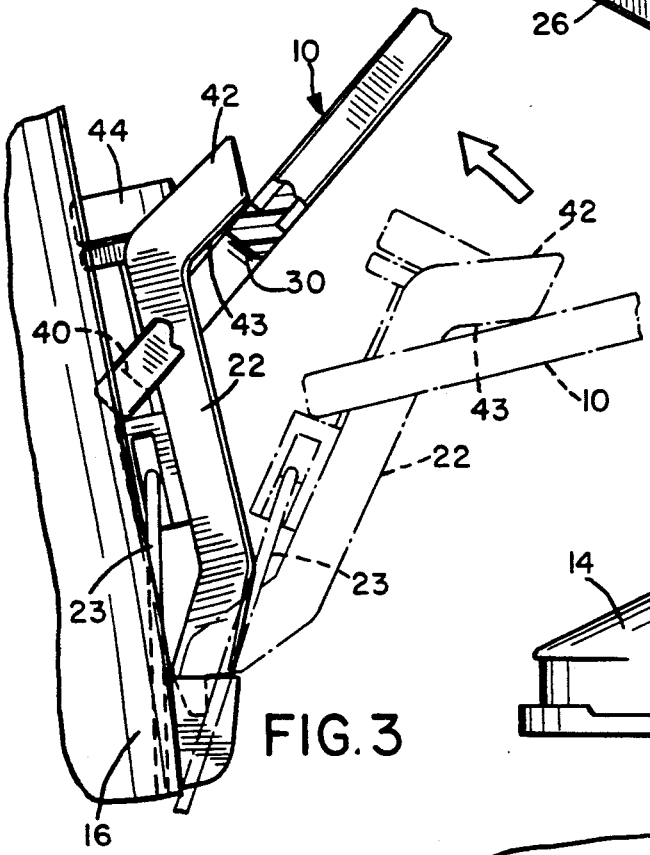
FIG. 3 is an enlarged side elevation view of the rear toggle latch with the key in use to close the latch.
Figure 4:
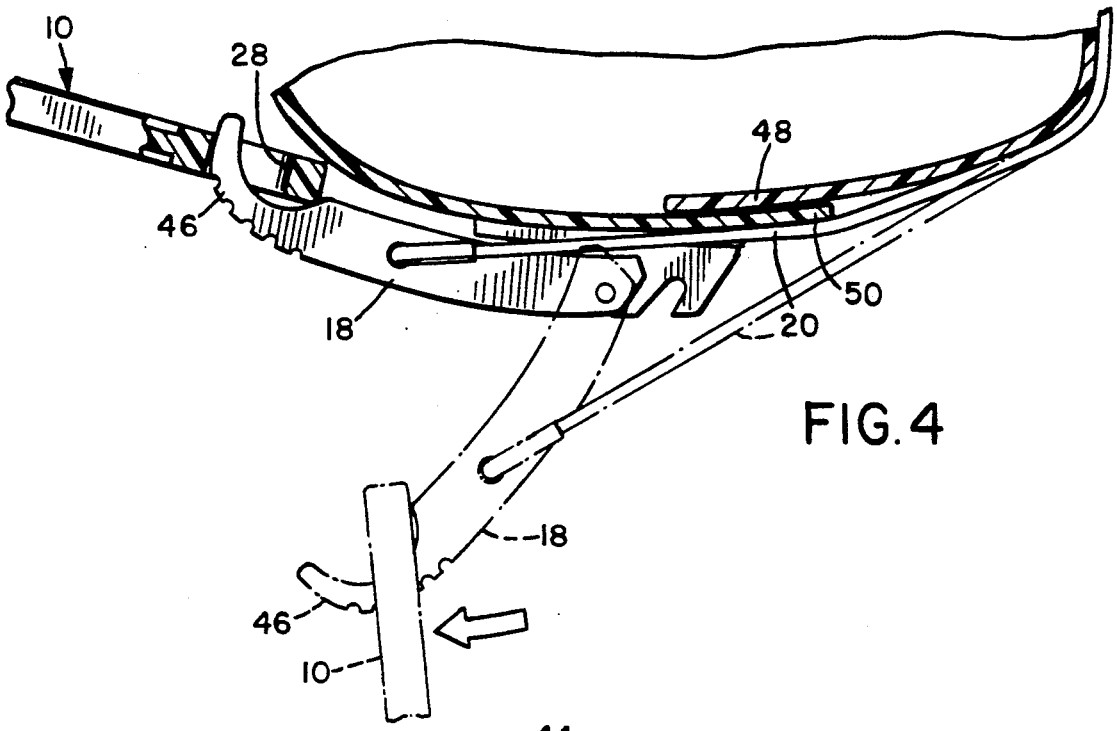
FIG. 4 is an enlarged sectional view taken on line 4—4 of FIG. 2, showing use of the key to close the side latch.

The key or operating device 10 is used to apply leverage to the pivotal latches to urge them towards their closed or latched positions. The closing operation is illustrated in FIGS. 3 and 4. FIG. 3 illustrates the closure of the rear opening toggle latch. The larger opening 30 of the key 10 is placed over the end 42 of the open toggle latch 22, as illustrated in dotted outline. The free end of the key is then urged upwards as indicated by the arrow, with the lower edge of opening 30 acting on the edge 43 of latch 22 to urge it inwards into the closed position shown in dotted outline. The key acts to apply leverage to the latch. Clearly, the thickness of the rim at the end of opening 30 must be small enough to enable it to be passed over the end 42 and tightening screw 44 of the latch 22 when the latch is in the closed position. There will typically be a small amount of free play in the latch when in the closed position illustrated in FIG. 3, and this will generally be sufficient to enable the key to be removed from the latch relatively easily when positioned as illustrated in solid outline in FIG. 3.

Figure 6:
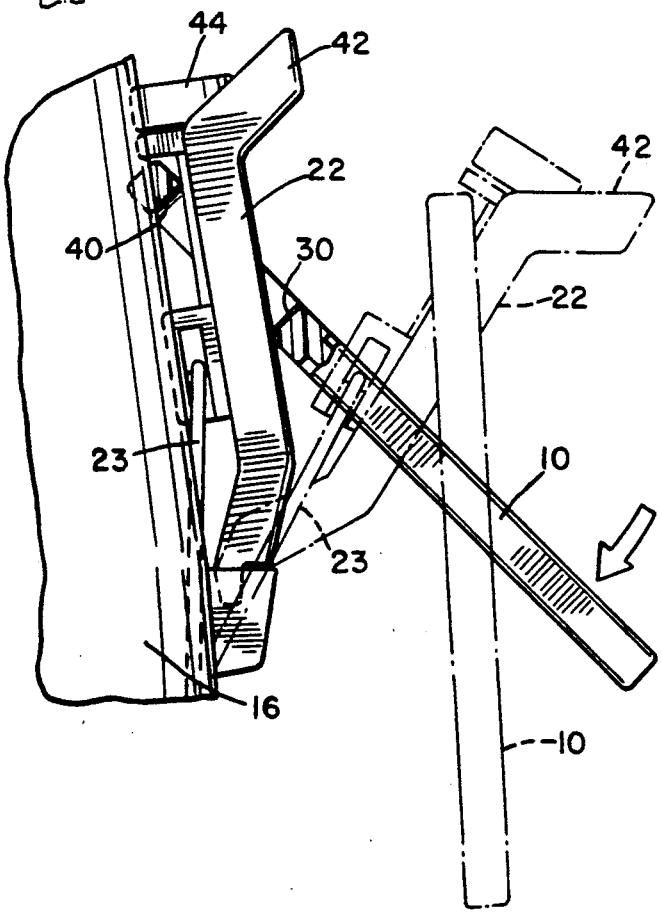
FIG. 6 is similar to FIG. 3 but illustrating opening of the rear latch.

The key may also be used in the opposite direction, with the free end pointing generally downwards, to apply leverage to open or release the latch, as illustrated in FIG. 6. By pushing the free end of the key in the direction of the arrow in FIG. 6, the opposite end of the key applies leverage to urge the latch 22 outwardly towards the open position illustrated in dotted outline.

Figure 5:
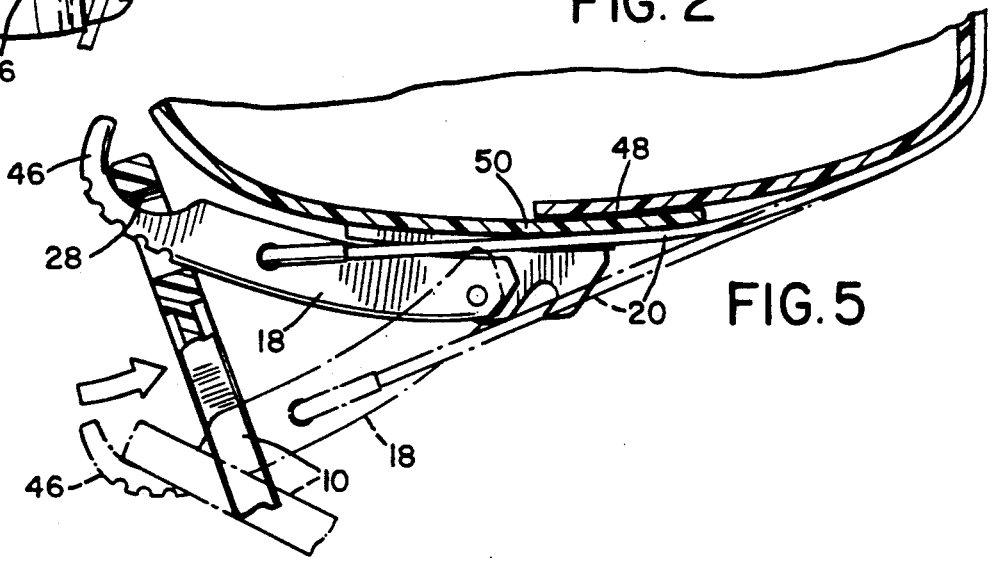
FIG. 5 is a view similar to FIG. 4 but illustrating use of the key to open a side latch.

FIG. 4 illustrates the closure of a side latch, while FIG. 5 illustrates opening of the latch. In order to close the latch, the smaller opening 28 of the key is placed over the end 46 of the latch in its released position (see FIG. 4). Again, leverage is applied by urging the free end of the key in the direction of the arrow in FIG. 4, with the top and bottom edges of opening 28 acting on the inner and outer faces of latch 18 to urge it inwardly into the solid line, closed position illustrated, allowing the overlapping side edges 48,50 of the boot to be drawn together and tightened.

Leverage may also be applied to open or release the latch by reversing the direction of the key on the latch, as indicated in FIG. 5. The opening 28 is placed over the end of the latch in its closed position as illustrated in FIG. 5, and the free end of the key is then urged inwardly in the direction of the arrow to urge the latch into its open/released position.

The key described above provides a relatively simple and effective tool for closing ski boot latches easily even when they are stiff or caked with snow or ice. Significantly less force is required to apply the necessary leverage to close the latches than would be needed to close the latches directly by hand, as has been done up to now. This key will therefore be a useful addition to anyone's standard skiing equipment, and will be particularly desirable for people who normally encounter difficulty when attempting to close ski boot latches or to re-open the latches to remove ski boots, for example women, children, or people having disabilities which tend to weaken their hands or reduce dexterity. The key can be attached securely to the user's clothing and kept in a pocket, for example, until needed. It can be used while still attached to the clothing, since the tether 36 is designed to be long enough to extend from the attachment point to the ski boot latches with some free play when the user bends down to remove the boot. Thus, it will not be lost even if inadvertently dropped in the snow.

Although a preferred embodiment of the invention has been described above by way of example only, it will be understood by those skilled in the field that modifications may be made to the disclosed embodiment without departing from the scope of the invention, which is defined by the appended claims.

I claim:

1. A ski boot operating tool for operating ski boot pivotal side and rear closure latches, comprising:

a rigid, generally flat elongate member of generally rectangular shape having a first, generally rectangular opening of predetermined dimensions at one end for fitting transversely over the end of a ski boot side closure latch, and a second, generally rectangular opening at an opposite end for fitting transversely over the end of a ski boot rear closure latch, said openings being different in size relative to each other and having rounded corners at least at their outermost ends and being oriented with opposite sides parallel with adjacent sides of said elongate member;

said elongate member having a central web portion of length at least equal to the length of one of the openings and extending between said openings, said web portion being recessed relative to a surface of said member, and the remainder of said elongate member comprising a peripheral rim of substantially uniform width and having substantially uniform thickness greater than the thickness of said recessed web portion, the rim extending around the entire periphery of both openings and around said central web portion, and including transverse rib portions separating each opening from said central web portion;

said peripheral rim being of predetermined thickness sufficient to apply leverage to a ski boot closure latch and slightly less than a gap between the end of the ski boot closure latch and an underlying portion of the ski boot in the closed position of the latch to enable said tool to be removed freely after closure of the latch.

2. A ski boot key for operating ski boot pivotal side and rear closure latches, comprising:

a rigid, elongate generally planar member having opposite, generally parallel end edges and opposite, elongate side edges and only two generally rectangular openings extending completely through said planar member, said openings being different in size relative to each other, one of said openings being adjacent one of said end edges and the other opening being adjacent the other of said end edges, each opening having opposite sides adjacent to and extending parallel with the respective opposite elongate side edges of said planar member, the first opening being of predetermined width slightly wider than the widths of a ski boot side closure latch and the second opening being of predetermined width slightly greater than the width of a ski boot rear closure latch such that the openings fit transversely over ski boot side and rear closure latches, respectively;

the planar member having a central web portion extending between said openings and a peripheral rim extending around the entire periphery of each of said openings and separating the inner end of each opening from said central web portion, the rim being thicker than said central web portion and being of substantially uniform thickness around the periphery of each opening, portions of said rim at opposite ends of each opening constituting means for applying leverage for operating a ski boot closure latch over which the respective opening is engaged.

3. The key as claimed in claim 2, wherein the member is of rigid plastics material.

4. A key as claimed in claim 2, including a tether line secured to the elongate member at one end of the tether line and having fastener means at an opposite end of the tether line for securing the key to a belt loop.

5. The key as claimed in claim 4, wherein the member has a tether opening in its central web portion between the first and second openings and said one end of the tether line is fastened through said tether opening.

6. The key as claimed in claim 5, wherein the tether opening is adjacent the first opening.

7. The key as claimed in claim 2, wherein the length of the central web portion is no less than that of the second opening.

8. The key as claimed in claim 2, wherein the first opening has a width of approximately 1 inch and a length of $\frac{1}{8}$inch, and the second opening has approximately 1.25 inch square dimensions.

9. The key as claimed in claim 2, wherein the thickness of the rim is $\frac{1}{4}$ inch.

* * * * *

UNITED STATES PATENT AND TRADEMARK OFFICE

CERTIFICATE OF CORRECTION

PATENT NO. : 5,090,277

DATED : February 25, 1992

INVENTOR(S) : MILDRED E. SPILLER

It is certified that error appears in the above-identified patent and that said Letters Patent is hereby corrected as shown below:

Column 5, Line 5 "oriented" should be --"orientated"--

Column 6, Line 37 "⅛" should read --"⅝"--

Signed and Sealed this

Seventeenth Day of August, 1993

*Attest:*

*Attesting Officer*

BRUCE LEHMAN

*Commissioner of Patents and Trademarks*